US005332200A

United States Patent [19]

Gorin et al.

[11] Patent Number: 5,332,200

[45] Date of Patent: Jul. 26, 1994

[54] SEGMENTED CERAMIC LINER FOR INDUCTION FURNACES

[75] Inventors: Andrew H. Gorin; Cressie E. Holcombe, both of Knoxville, Tenn.

[73] Assignee: Martin Marietta Energy Systems, Inc., Oak Ridge, Tenn.

[21] Appl. No.: 959,580

[22] Filed: Oct. 13, 1992

[51] Int. Cl.[5] ..... C21B 7/04

[52] U.S. Cl. ..... 266/280; 266/286; 373/137

[58] Field of Search ..... 266/280, 286, 242, 281, 266/283; 373/137

[56] References Cited

U.S. PATENT DOCUMENTS

| | | | |
|---|---|---|---|
| 3,687,437 | 8/1972 | Fischer | 266/242 |
| 3,942,293 | 3/1976 | Cook | 52/232 |
| 4,006,891 | 2/1977 | Ford | 266/284 |
| 4,130,924 | 12/1978 | Madill | 266/286 |
| 4,480,820 | 11/1984 | Zhukov et al. | 266/44 |
| 4,493,089 | 1/1985 | Abell | 373/137 |
| 4,697,632 | 10/1987 | Lirones | 266/280 |
| 4,802,436 | 2/1989 | Wilson et al. | 164/440 |
| 4,823,359 | 4/1989 | Ault et al. | 373/137 |
| 4,912,068 | 3/1990 | Michael et al. | 266/280 |
| 4,957,887 | 9/1990 | Michael et al. | 266/280 |

*Primary Examiner*—Scott Kastler

*Attorney, Agent, or Firm*—Earl Larcher; Ivan L. Ericson; Harold W. Adams

[57] ABSTRACT

A non-fibrous ceramic liner for induction furnaces is provided by vertically stackable ring-shaped liner segments made of ceramic material in a light-weight cellular form. The liner segments can each be fabricated as a single unit or from a plurality of arcuate segments joined together by an interlocking mechanism. Also, the liner segments can be formed of a single ceramic material or can be constructed of multiple concentric layers with the layers being of different ceramic materials and/or cellular forms. Thermomechanically damaged liner segments are selectively replaceable in the furnace.

14 Claims, 2 Drawing Sheets

SEGMENTED CERAMIC LINER FOR INDUCTION FURNACES

This invention was made with the support of the United States Government under contract No. DE-AC05-84OR21400 awarded by the U.S. Department of Energy. The United States Government has certain rights in this invention.

BACKGROUND OF THE INVENTION

The present invention relates generally to liners for electrically heated furnaces, and more particularly to such liners as provided by stacked cylindrical segments of ceramic material in light weight cellular form.

Generally, induction heated furnaces used in metallurgical processes such as in the melting, casting, and annealing of metals are usually constructed of a cylindrical metal shell, an annular layer of thermal insulating material next to the shell, an induction heating coil next to the thermal insulating layer, and a cylindrical liner of firebrick radially inwardly from the induction heating coil. The firebrick liners used in such furnaces are assembled in situ in the furnace by cementing together individual firebricks. These liners, especially in the upper regions thereof, are subject to considerable thermomechanical degradation during the use of the furnace and when the degradation of such liner reaches a certain level, the firebricks must be removed from the furnace and replaced with a new firebrick lining. This replacement of firebrick liners occurs on a relatively regular basis in induction furnaces and requires that a mason remove and replace the firebrick within the confines of the furnace.

In some applications of the induction furnaces, various metals utilized in the metallurgical processes would pose health problems to a worker replacing the firebrick liner in the metal-processing cavity of the furnace. For example, an induction furnace in which a radioactive material such as uranium or a uranium alloy was subjected to a metallurgical process would constitute a serious health threat to a mason working within the confines of the furnace due to the radioactive contaminants remaining on surfaces in the furnace interior including the degraded firebrick liner being replaced.

Efforts to overcome the problems associated with the use of liners formed of individual firebricks, as briefly described above, include the use of one piece or multiple-piece liners formed of fibrous ceramic material. These fiber-containing liners are relatively light and can be removed from and replaced in the furnace cavity without requiring that a worker enter the confines of the furnace. However, recent investigations have shown that the ceramic fibers used in these liners are considered to be a health hazard and that the use of such ceramic fibers as furnace liners is expected to be extensively regulated or even curtailed by legislation in the near future.

SUMMARY OF THE INVENTION

Accordingly, it is a principal aim or objective of the present invention to provide a non-fibrous liner for induction furnaces which can be readily replaced in part or in whole without requiring that a worker enter the furnace so as to obviate or at least significantly reduce any risks to the health of the worker replacing the liner due to the particular metals processed in the furnace or to the materials used in the construction of the liner.

This objective of the present invention is achieved by providing induction heated furnaces with a readily replaceable liner fabricated from a plurality of stacked cylindrical ring-shaped segments of a ceramic material in a light-weight cellular form as provided by bonded together ceramic spheres, reticulated ceramic foam, or a ceramic honeycomb structure.

Another object of the present invention is to provide such a segmented liner wherein each ring-shaped liner segment is formed of a one piece construction or of several arcuate sections joined together, preferably with interlocking means for forming a tortuous path at the interface or seam between the arcuate sections for preventing radiative heat losses.

A further object of the present invention is to provide end surfaces on adjacently disposed liner segments with complementary surface configurations which are capable of maintaining the stacked liner segments in a coaxial alignment and which define a tortuous path at the interface between the stacked liner segments for preventing radiative heat losses.

A still further object of the present invention is to provide this segmented liner with attachable lifting means whereby the segmented liner can in part or in entirely be removed from and replaced in the furnace cavity.

A still further object of the present invention is to form each segment of the liner of concentric cylindrical layers formed of different ceramic materials and/or different cellular forms so as to enable the liner to be tailored for use in furnaces operated at a particular temperature.

Generally, the present invention is an improved furnace liner useable in a furnace comprising an upright shell having top and bottom closure means and containing electric heating means and thermal insulating means intermediate to the heating means and the shell. The improved liner is generally cylindrical and disposed radially inwardly from the heating means. This liner comprises a plurality of elongated generally cylindrical ring-shaped liner segments with circumferential inner and outer surface regions and stacked open end to open end upon one another within the furnace shell with end surface regions of adjacently disposed liner segments being disposed in an abutting relationship and with end surface regions at opposite longitudinal ends of each liner segment being disposed in substantially parallel planes. Each of the liner segments is of a substantially cellular construction and formed of at least one ceramic material.

The ceramic material is alumina, mullite, partially stabilized zirconia, magnesium oxide, yttrium oxide, zirconia-opacified mullite, or a combination thereof.

The substantially cellular construction is provided by a structural form such as bonded-together hollow ceramic spheres in a ceramic matrix, reticulated ceramic foam, or a ceramic honeycomb.

Other and further objects of the present invention will become obvious upon an understanding of the illustrative embodiments about to be described or will be indicated in the appended claims, and various advantages not referred to herein will occur to one skilled in the art upon employment of the invention in practice.

Preferred embodiments of the invention have been chosen for the purpose of illustration and description. The preferred embodiments illustrated are not intended to be exhaustive nor to limit the invention to the precise forms shown. The preferred embodiments are chosen and described in order to best explain the principles of the invention and their application and practical use to thereby enable others skilled in the art to best utilize the invention in various embodiments and modifications as are best adapted to the particular use contemplated.

DETAILED DESCRIPTION OF THE INVENTION

Figure 1:
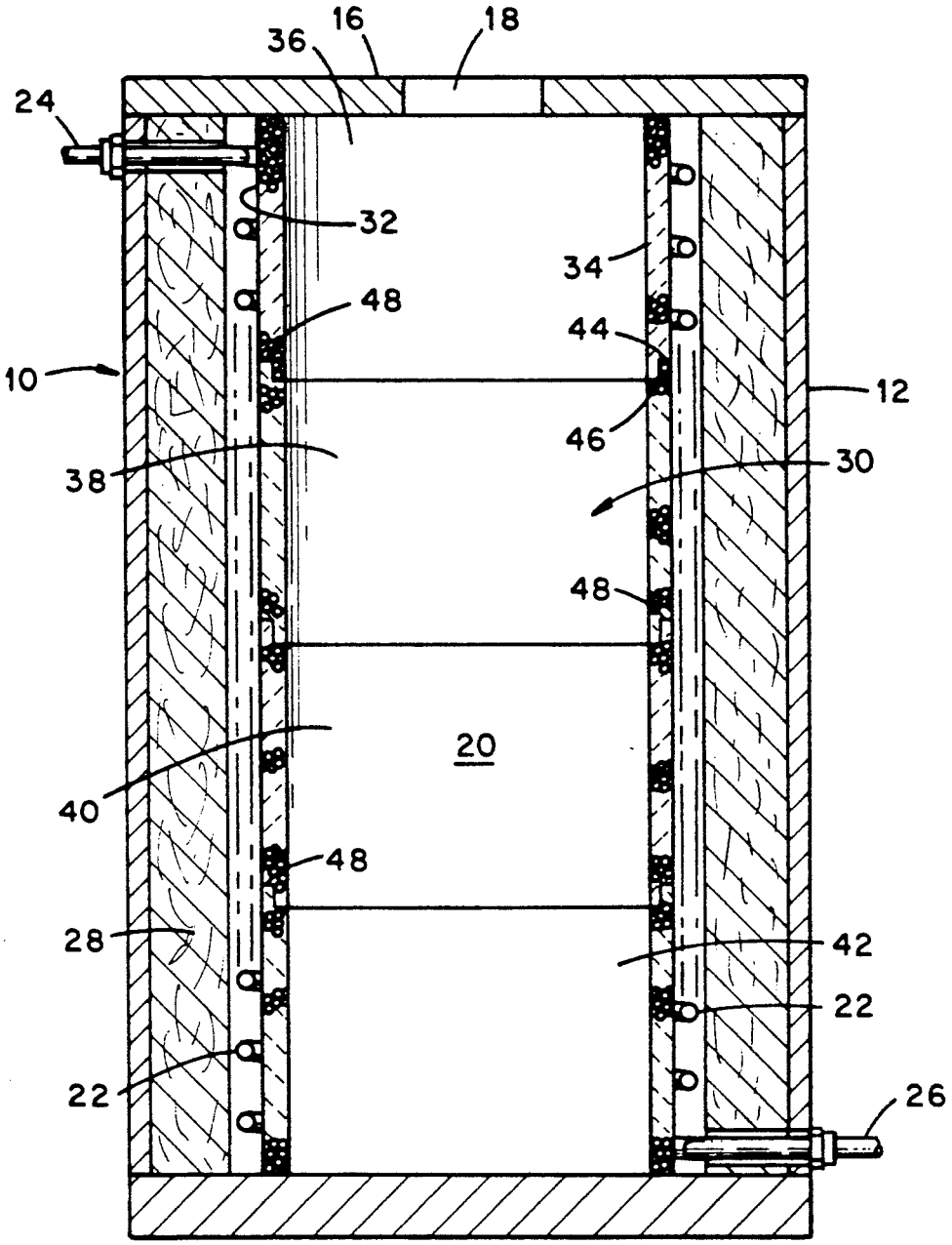
FIG. 1 is a vertical, sectional view generally illustrating an induction heated furnace provided with one embodiment of the non-fibrous segmented liner of the present invention.

As briefly described above, the present invention is directed to a non-fibrous liner of ceramic material in a light-weight cellular form that is particularly suitable for use in an induction heated furnace in place of the liner of the type previously formed of cemented firebrick or fibrous ceramic material. As generally shown in FIG. 1, such an induction heated furnace 10 basically comprises an upright cylindrical vessel or shell 12 fitted with a hearth or base 14 and a top end cap 16 having a central opening 18 therein for introducing metals, alloys or alloying constituents into the central cavity 20 of the furnace usually containing a crucible (not shown) for a metallurgical procedure such as the melting, casting, or annealing of the introduced material. The shell 12 and the top end cap 16 are usually formed of steel while the base 14 may be formed of either steel or a refractory material dependent upon the particular use of the furnace. Also, in many furnaces the base 14 may be selectively removed or fitted with a suitable mechanism for enabling the removal of the crucible or the discharge of the metallurgically treated material from the furnace cavity 20. The shell 12 contains an induction heating coil 22 which is radially inwardly spaced from the shell 12 and encompasses the central cavity 20. The heating coil 22 is shown extending substantially the full height or the longitudinal length of the furnace interior so as to be capable of uniformly heating metals and alloys in the furnace cavity 20 during the desired metallurgical processes. The heating coil 22 may be of any suitable type and construction such as a water-cooled copper tubing and is shown provided with electrical leads 24 and 26. The shell 12 also contains a layer 28 of thermal insulation in the annulus between the heating coil 22 and the interior walls of the shell 12 for minimizing heat losses through the shell 12 during the operation of the furnace. This layer 28 of a thermal insulation which usually remains in place and is unchanged during the life of the furnace, is formed of any suitable insulating material such as mineral wool, bubbled alumina, or bubbled zirconia.

The non-fibrous, segmented furnace liner 30 of the present invention is of an elongated generally annular or cylindrical configuration and is contained in an upright manner within the shell 12 with the outer wall regions 32 of the liner 30 located radially inwardly from the heating coil 22. If desired, a sheet of mica or the like (not shown) may be placed between the heating coil 22 and liner 30 for heat distribution purposes. The inner wall regions 34 of the liner 30 together with the base 14 and the top end cap 16 define the central or working cavity 20 within the furnace 10.

The liner 30 of the present invention can be satisfactorily employed in induction furnaces having working cavities in diameters in the range of about 20 to 60 inches and heights or longitudinal dimensions in the range of about 40 to 150 inches. By way of example and for the purpose of this description, the furnace in cavity 20 of FIG. 1 is of the diameter of $\approx$40 inches and a height of $\approx$95 inches. A cross-sectional thickness of liner 30 between the outer wall regions 32 and the inner wall regions 34 is in the range of about 0.05 inch to 4 inches, preferably about 0.75 inch. In an induction furnace of such dimensions, the liner 30 is conveniently formed of a multiple number of ring-shaped liner segments such as the four liner segments shown in FIG. 1 at 36, 38, 40, and 42. These individual liner segments are coaxially stacked upon one another to form the liner 30.

The uppermost portion of the liner 30, representing approximately the top 40 inches of the furnace cavity 20, is normally subjected to the greatest thermomechanical degradation during the furnace operation. Thus, the two upper ring segments 36 and 38 are preferably each provided with a longitudinal dimension of about 22.5 inches so that one or both of these liner segments 36 and 38 can be readily removed from the furnace cavity 20 and replaced with new correspondingly sized and configured liner segments. Such fractional replacement of the furnace liner 30 significantly reduces liner replacement costs such as heretofore encountered.

While four liner segments 36, 38, 40, and 42 are shown in FIG. 1, it will appear clear that any number of liner segments of any desired dimensions can be utilized for manufacturing the furnace liner 30 in accordance with the present invention. The removal and replacement of these liner segments is achieved by any suitable lifting means such as will be described below.

The furnace liner 30 in each of the embodiments of the present invention shown in FIGS. 1-5 is constructed of one or more ceramic materials in a light-weight cellular form. The ceramic materials suitable for the construction of the liner 30 include alumina, mullite, partially-stabilized zirconia, magnesium oxide, clay, spinel, cordierite, yttrium oxide, zirconia-opacified mullite, and a mixture or combination of these ceramic materials. When high melting metals or alloys including uranium or uranium alloys are being subjected to a metallurgical process in the furnace 10, the liners are preferably constructed of alumina, mullite, partially-stabilized zirconia, or zirconia-opacified mullite since these ceramic materials possess desirable thermal conductivity levels and will retain structural integrity at the relatively high temperatures as required for processing such high melting metals and alloys.

The liner segments 36, 38, 40, and 42 of FIG. 1 and liner segments in the other illustrated embodiments are provided by fabricating the selected ceramic material into a light-weight cellular structure such as provided by bonding together hollow ceramic spheres, forming a reticulated foam of the ceramic material, or forming a honeycomb structure from the ceramic material. The weight of these cellular structures is in the range of about 20 to 50 lb/ft$^3$.

The bonded together hollow ceramic spheres are preferably prepared from light-weight phase-bonded ceramic composite castables using mono-sized hollow ceramic spheres as the foundation of the casting. Such a bonded ceramic spherical product is available from Ceramic Fillers Inc., Atlanta, Ga. These castings of bonded hollow ceramic spheres suitable for forming the lining of the present invention are of a density in the range of about 30 to 35 lb/ft$^3$.

Liner segments of reticulated ceramic foam can be readily prepared in desired density range by admixing ceramic powders with a suitable pore former such as ammonium carbonate and a binder such as a furan resin, that can be essentially, preferably entirely, volatilized from the mixture when the mixture is heated to a temperature adequate to sinter the ceramic powders to form an integral self-supporting liner ring segment. These reticulated ceramic foams can be provided with densities in the range of about 20 to 50 lb/ft$^3$.

The ceramic honeycomb structure may be prepared by using a conventional process such as coating an organic honeycomb structure with a slurry containing ceramic particulates and a cellulosic binder and suspension agent, drying the coated structure, and then heating the coated structure in air to a temperature adequate to oxidize away the organics while sintering together the ceramic particles to retain the honeycomb structure. The ceramic honeycomb structure can be readily provided wi a density in the range of about 20 to 50 lb/ft$^3$.

The particular processes for forming the light-weight cellular ceramic structures used for forming the liner segments of the present invention are not critical to the present invention and any suitable cellular structure of the aforementioned ceramic materials which will meet the desired weight, thermal conductivity, and temperature requirements for the segmented liner 30 may be used without departing from the spirit and scope of the present invention.

In order to minimize radiative heat transfer through the liner 30 at the seams of interfaces between stacked liner segments, the top and bottom ends of each pair of adjacently disposed liner segments, such as segments 36 and 38, 38 and 40, and 40 and 42, that are positioned in an abutting relationship are preferably provided with complementary surface features which will establish a tortuous path at these seams or interfaces. Such tortuous paths at the interfaces between the stacked liner segments obviates the formation of straight through slots where radiated heat can leak through between the furnace cavity 20 to the heating coil side of the liner thereby causing undesirable heat losses. For example, with liners formed of firebrick, the use of mortar between the bricks is essential to prevent high temperature radiative heat losses. Also, to facilitate the stacking of the liner segments together in a close fitting abutting relationship, the liner segments are preferably provided with tortuous path-forming bends and curves at the top and bottom ends thereof which are complementary and essentially parallel to one another so that the liner segments will be essentially disposed in parallel horizontal planes when assembled into a completed liner 30.

Figure 5:
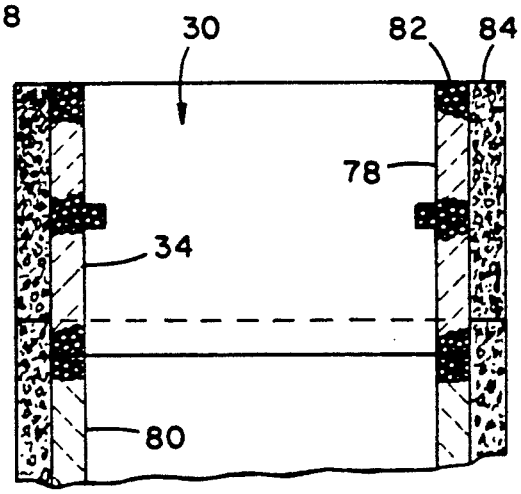
FIG. 5 is a vertical, sectional view taken along lines 5—5 of FIG. 4 showing further details of the liner construction.

In FIG. 1 the liner segments 36, 38, 40, and 42 are preferably provided with tortuous path-forming end surfaces which are configured to enable the liner segments to be placed together for assuring the formation of an "unbroken" liner of close fitting coaxially aligned liner segments. As shown, the bottom end surface 44 of liner segment 36 and the top end surface 46 of liner 38 are provided with circumferentially extending inner and outer surface portions in horizontal planes different from one another so as to provide a "stepped" or stair-like structure 48 between the liner segments 36 and 38. The abutting end surface regions of liner segments 38 and 40, and 40 and 42 are provided with similar stair-like structures. With such a stair-like structure, the innermost surface portion on the top end surface of each liner segment 38, 40, and 42 lies in a horizontal plane lower than the radially outermost surface portion of the bottom end surfaces of the liner segments 36, 38 and 40 so as to provide a construction which facilitates the replacement of the damaged liner segments. For example, with such a stair-like construction the top liner segment 36 can be easily removed by lifting the liner segment from the furnace or by simply breaking the damaged liner segment and then removing the broken segment from the furnace by dropping it through the bottom of the furnace. With the stair-like construction at the ends of the liner segments as shown in FIGS. 1 and 5, the upper and lower surface portions defining the stepped regions will each preferably radially extend about half the thickness of the liner.

The individual liner segments of the present invention may be formed as a single unit or of multiple arcuate sections joined together by a suitable interlocking mechanism which also defines a tortuous path between the inner and outer surfaces of each liner segment for inhibiting radiative heat losses.

Figure 2:
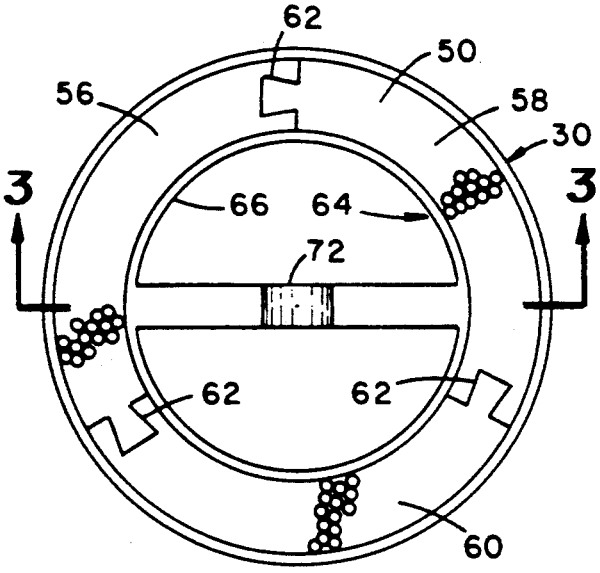
FIG. 2 is a top plan view showing another embodiment of the segmented furnace liner of the present invention with the ring-shaped segments of the liner formed of multiple arcuate sections and with the liner provided with a lifting mechanism.
Figure 3:
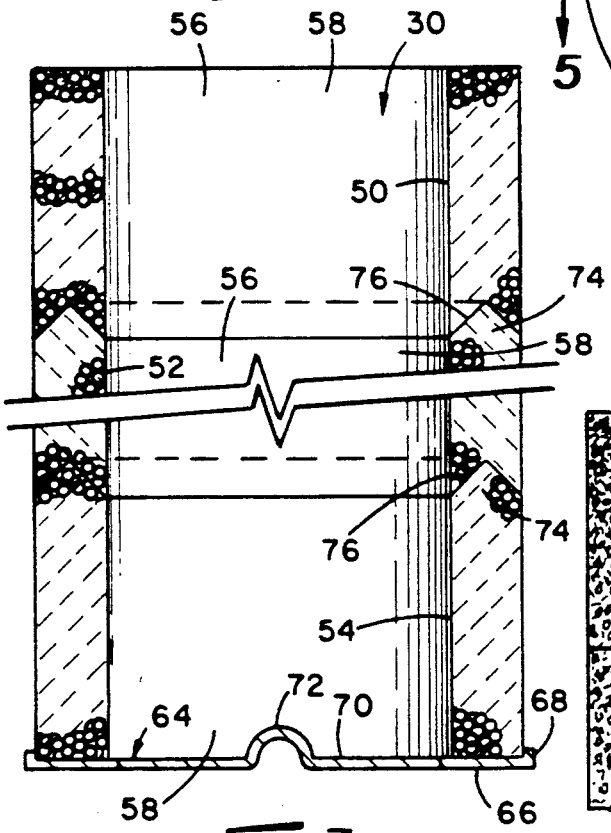
FIG. 3 is a vertical, sectional view taken along lines 3—3 of FIG. 2 showing further details of the liner construction and the liner lifting mechanism.

With reference to the embodiments illustrated in FIGS. 2 and 3, the liner segments 50, 52, and 54 forming the liner 30 are each shown fabricated from three arcuate sections 56, 58, and 60 joined together with a tongue and groove or dovetail mechanism 62 which interlocks the sections 56, 58, and 60 together to form an integral liner segment without incurring radiative heat losses at the interface between the individual liner sections. The interlocking mechanism 62 preferably vertically extends the full length of the ring segment between the top and bottom ends of each liner segment to assure the formation of an integral ring structure as well as to prevent radiative heat losses at the seams between the joined-together liner sections.

In FIGS. 2 and 3, the liner 30 is shown provided with a lifting fixture 64 of a suitable material such as steel or the like positioned under the lowermost end of the liner 30 so as to provide a mechanism by which the liner 30 can be positioned in the furnace cavity 20 or by which the liner 30 may be lifted from the furnace cavity 20 so that one or more liner segments thereof can be replaced with undamaged liner segments. This lifting fixture is shown comprising an annular, generally planar base plate 66 having inner and outer diameters essentially the same as the liner 30 being supported thereon. Preferably, the outer diameter of the base plate 66 is slightly greater than that of the liner 30 so that a circular flange 68 can be positioned about the outer edge of the liner to facilitate the supporting of the liner 30 thereon. The base plate 66 is fitted with a diametrically extending bar 70 having a raised or curved central portion 72 which is used to provide a surface suitable for engagement by a hook or the like of a lifting device such as a hoist (not shown) for vertically displacing the liner in the furnace cavity 20.

FIG. 3 illustrates a further coupling arrangement between the vertically stacked liner segments which prevents radiative heat losses and assures that the stacked liner segments remain coaxially aligned within the furnace cavity 20. As shown, the top end region of the liner segments 52 and 54 are provided with a circumferentially extending tongue-like projection 74 which is received in a complementary configured, circumferentially extending groove or recess 76 in the bottom end regions of liner segments 50 and 52. The tongue-like projections may be of a longitudinal length of about 0.25 inch to 2 inches which is sufficient to maintain alignment of the liner segments and provide a tortuous path for preventing radiative heat losses at the interface between the liner segments.

Figure 4:
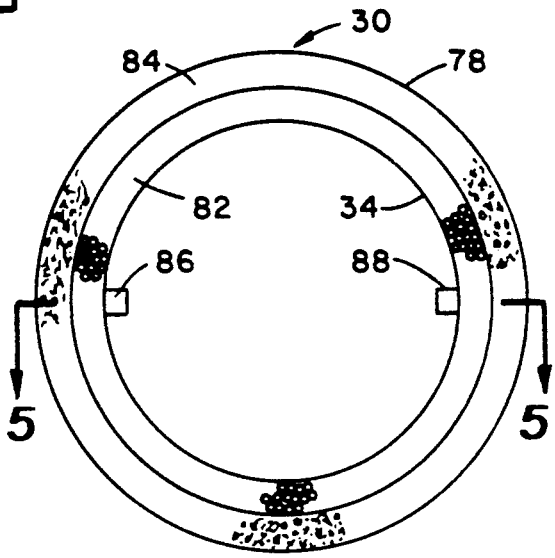
FIG. 4 is a top plan view of a further embodiment of the segmented furnace liner of the present invention showing a liner segment formed of two concentrically disposed cylindrical layers of different ceramic materials and with the liner segment provided with lifting knobs.

With reference to FIGS. 4 and 5, two segments 78 and 80 of the furnace liner 30 are shown being formed of concentrically disposed inner and outer layers 82 and 84 of ceramic material. These concentric layers 82 and 84 forming the liner segments are formed of different ceramic materials or of the same ceramic materials but of different cellular construction so as to selectively tailor the liner segments for use in induction furnaces employing metallurgical processes at particular temperatures. With the liner segments 78 and 80 being formed of two layers 82 and 84, the layers are preferably each of a thickness corresponding to approximately one-half the cross-sectional thickness of the liner segment. For example, if the liner segments 78 and 80 have a cross-sectional thickness of 0.75 inch, the layers 82 and 84 are each of approximately 3.75 inch in thickness. Alternatively, if desired, the inner layer of the outer layer could be of a thickness about 0.25 inch while the other layer could be of a thickness of about 0.50 inch. The use of layers of different thicknesses would permit even further tailoring of the liner for use at a particular temperature.

By using these concentrically layered liners, the cellular structures and the ceramic material employed therein can be selected so that the cellular ceramic material and/or cellular structure showing the best resistance to thermomechanical damage can be utilized on the inner surface of the liner 30. The liner segments 80 and 82 may be conveniently formed in the two-layer construction for the purpose of increasing maximum temperature usage of the liner by forming the inner liner layer 82 of partially-stabilized zirconia and the outer layer 84 of alumina, mullite, or zirconia-opacified mullite.

Instead of constructing the liner segments of two concentric layers as shown in FIGS. 4 and 5, the liner can be formed of even greater number of concentric layers. For example, a liner formed of three concentric layers can be readily produced by forming each of the layers with a cross-sectional thickness of about 0.25 inch for a liner with a cross-sectional thickness of 0.75 inch. With the liner segments formed of three layers, the inner layer would be preferably formed of partially stabilized zirconia, the intermediate layer would be preferably formed of zirconia-opacified mullite, or mullite, and the outermost layer would be preferably formed of mullite or alumina.

The liner segments 78 and 80 illustrated in FIGS. 4 and 5 are shown provided with radially inwardly extending knobs or projections 86 and 88 on the inner wall regions 34 thereof at circumferentially spaced apart locations. These knobs 86 and 88 are of a sufficient radial length of about 0.5 to 1.0 inch and of a diameter of about 0.5 to 2 inches so as to permit ready engagement by a receptacle-type connector (not shown) for lifting the liner segment and any segment thereon from the furnace cavity 20. If desired, each ring segment of the liner can be provided with such projections so that the damaged top liner segment or segments thereunder can be selectively removed and replaced in the furnace cavity 20 without disturbing the lower liner segments of the liner 30.

It will be seen that the present invention provides a non-fibrous light-weight ceramic liner for use in induction heated furnaces with the liner segments being replaceable in a selective and relatively easy manner as compared to previously known induction furnace liners, especially those of the type in which the liner was formed by a worker inside the furnace such as in the case of firebrick liners.

What is claimed is:

1. In a furnace comprising an upright shell having top and bottom closure means and containing electric heating mean, thermal insulating means intermediate to the heating means and the shell, and an improved substantially cylindrical liner disposed radially inwardly from the heating means, said liner comprising a plurality of elongated substantially cylindrical ring-shaped liner segments with circumferential inner and outer surface regions and stacked open end to open end upon one another within said shell with end surface regions of adjacently disposed liner segments being disposed in an abutting relationship and with end surface regions at opposite longitudinal ends of each liner segment being disposed in substantially parallel planes, each end surface region of each liner segment having a shaped vertically offset surface portion complementary to a shaped vertically offset surface portion on the end region of an adjacently disposed liner segment for defining a tortuous path between the inner and outer surface regions at the interface between the adjacently disposed liner segments, and with each of said liner segments being of a substantially cellular construction provided by a fiber-free structural form selected from the group consisting of bonded-together hollow ceramic spheres in a ceramic matrix, reticulated ceramic foam, and a ceramic honeycomb and with said structural form being of at least one ceramic material selected from the group consisting of alumina, mullite, partially stabilized zirconia, magnesium oxide, clay, spinel, cordierite, yttrium oxide, zirconia-opacified mullite, and mixtures thereof.

2. In a furnace as claimed in claim 1, wherein each liner segment is formed of a one-piece construction.

3. In a furnace as claimed in claim 1, wherein each liner segment comprises a plurality of arcuate sections each having circumferentially spaced apart ends, and wherein each plurality of arcuate sections are joined together at the circumferential ends thereof to form an integral liner segment.

4. In a furnace as claimed in claim 3, wherein each of said arcuate sections include interlocking means at the circumferential ends thereof, and wherein the interlocking means are adapted to engage complementary interlocking means on adjacently disposed arcuate sections to connect the arcuate sections together.

5. In a furnace as claimed in claim 4, wherein said interlocking means are shaped to provide a tortuous path at the interface between connected arcuate sections.

6. In a furnace as claimed in claim 5, wherein the interlocking means comprise tongue means supported on at least one end of one of said arcuate sections and groove means supported on at least one end of another of said arcuate sections and adapted to receive said tongue means.

7. In a furnace as claimed in claim 1, wherein the shaped complementary surface portions are provided by a stepped construction defined by a first surface portion adjacent to the inner surface region of a liner segment being in a horizontal plane different from a second surface portion adjacent to the outer surface region thereof.

8. In a furnace as claimed in claim 1, wherein the shaped complementary surface portions are provided by projection means on at least one of the end surface regions of one the liner segments and recess means in at least one of the top and bottom end surface regions a liner segment disposed adjacent to said one liner segment, and wherein said recess means is adapted to receive said projection means therein for providing said tortuous path.

9. In a furnace as claimed in claim 1, wherein each of said liner segments is formed of multiple concentric layers consisting essentially of a first circumferential layer formed of one of said ceramic materials and at least one other circumferential layer radially spaced from the first layer and formed of another of said ceramic materials or the same ceramic material in a different cellular form, wherein said circumferential layers are concentrically stacked together in an abutting relationship, and wherein each circumferential layer extends between top and bottom end surface regions on each liner segment.

10. In a furnace as claimed in claim 9, wherein said first layer is formed of partially-stabilized zirconia, wherein said at least one other circumferential layer is provided by a second layer of radially outwardly from said first layer, and wherein said second layer is formed of mullite, alumina or zirconia-opacified mullite.

11. In a furnace as claimed in claim 9, wherein said at least one other circumferential layer is provided by a second layer of radially outwardly from said first layer and a third layer radially outwardly from the second layer, wherein said first layer is formed of partially-stabilized zirconia, wherein said second layer is formed of mullite or zirconia-opacified mullite, and wherein said third layer is formed of mullite or alumina.

12. In a furnace as claimed in claim 1, wherein means engageable by lifting means are attached to at least one of said liner segments for vertical displacement of said at least one of the liner segments.

13. In a furnace as claimed in claim 12, wherein said means engageable by the lifting means comprises plate means disposed adjacent to the bottom end surface region of the lowermost liner segment in the stack of liner segments forming the liner, and wherein said plate means is provided with engageable surface means adapted to be engaged by the lifting means for vertically displacing the stacked liner segments with respect to said shell.

14. In a furnace as claimed in claim 12, wherein said means engageable by the lifting means comprises a plurality of radially inwardly extending projection means at circumferentially spaced apart locations on the inner cylindrical surface region of at least one of stacked liner segments forming said liner, and wherein said projection means are adapted to be engaged by the lifting means for vertically displacing said at least one liner segment with respect to said shell.

* * * * *